US006230512B1

(12) United States Patent
Correa

(10) Patent No.: US 6,230,512 B1
(45) Date of Patent: May 15, 2001

(54) MOUNTING OF ELECTRONIC COMPONENTS IN AN AIR CONDITIONER

(75) Inventor: Juan Carlos Carne Correa, Porto Alegre (BR)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/485,564

(22) PCT Filed: Jun. 22, 1998

(86) PCT No.: PCT/BR98/00035

§ 371 Date: Feb. 14, 2000

§ 102(e) Date: Feb. 14, 2000

(87) PCT Pub. No.: WO99/67579

PCT Pub. Date: Dec. 29, 1999

(51) Int. Cl.[7] ..... F25D 23/08
(52) U.S. Cl. ..... 62/298; 62/262
(58) Field of Search ..... 62/298, 262

(56) References Cited

U.S. PATENT DOCUMENTS 4,977,750 * 12/1990 Metcalfe ..... 62/77
5,461,880 * 10/1995 Bolton et al. ..... 62/298

FOREIGN PATENT DOCUMENTS 03177722 10/1991 (EP) .
10061973 6/1998 (EP) .
2304400 3/1997 (GB) .
58-160750A * 9/1983 (JP) ..... 62/298
6-42771A * 2/1994 (JP) ..... 62/298
6-221608A * 8/1994 (JP) ..... 62/298

* cited by examiner

*Primary Examiner*—William Doerrler
*Assistant Examiner*—Melvin Jones

(57) ABSTRACT

An air conditioning unit includes a vertically extending structural wall, which forms an internal side of the unit. The wall is formed from a structural plastic material, which has molded therein a pair of spaced support means, which are configured to supportingly engage two adjacent corners of a substantially rectangular electrical component of the air conditioning unit. Also molded integrally into the structural internal wall is a deformable latch located so as to engage the side of the rectangular component, which is opposite from the two adjacent corners. The latch is configured to cooperate with the pair of spaced support means to support the rectangular component in parallel relation to the wall when the latch is in a first undeformed position, and to allow installation or removal of said rectangular component when said latch is in a second deformed position.

6 Claims, 5 Drawing Sheets

MOUNTING OF ELECTRONIC COMPONENTS IN AN AIR CONDITIONER

TECHNICAL FIELD

The invention generally relates to air distribution units of the type commonly used in air conditioning, heating or ventilation systems.

BACKGROUND ART

In many commercial air conditioning, heating and ventilating systems, treated air is discharged into an area to be conditioned through an air distribution or conditioning unit. For example, one general type of air conditioning system, often referred to as a split system, includes separate indoor and outdoor units. The outdoor unit includes a compressor, a heat exchanger and a fan. The indoor unit includes a heat exchanger and a fan. In operation, the indoor fan draws air into the indoor unit, through an inlet thereof, and forces the air over the indoor heat exchanger and then out of the indoor unit, through an outlet opening therein.

The outdoor fan draws air into the outdoor unit, through an inlet, forces that air over the outdoor heat exchanger and then forces that air out of the outdoor unit through an outlet therein. At the same time, a compressor causes a refrigeration fluid to circulate through and between the indoor/outdoor heat exchangers. At the indoor heat exchanger, the refrigerant absorbs heat from the air passing over that heat exchanger, cooling that air. At the same time, at the outdoor heat exchanger, the air passing over the heat exchanger absorbs heat from the refrigerant passing therethrough.

Split type air conditioning units of this type are typically manufactured in a wide range of cooling capacities. Accordingly, the size of the indoor unit can range from a small compact relatively narrow unit up to a wide unit, of substantially the same height as the compact unit.

In manufacturing such units, particularly as the units become larger, the fabrication of certain components, such as those comprising the front cover portion of the unit, become onerous and cumbersome in size. Such large size results in components which are difficult to manufacture and difficult to handle, both during manufacture and assembly of the units.

Typically, the larger the unit the more components are required and the more fasteners are required in order to assemble all of the components. It is considered extremely desirable to minimize the number of components required in order to fabricate the indoor units of such an air conditioning system.

Such indoor units of air conditioners are typically provided with mechanical and/or electronic control components. It is considered desirable to minimize the amount of space and the number of components necessary in order to mount such control mechanisms and electrical and/or electronic components associated therewith.

DISCLOSURE OF THE INVENTION

An air conditioning unit includes a vertically extending structural wall, which forms an internal side of the unit. The wall is formed from a structural plastic material, which has molded therein a pair of spaced support means, which are configured to supportingly engage two adjacent comers of a substantially rectangular electrical component of the air conditioning unit. Also molded integrally into the structural internal wall is a deformable latch located so as to engage the side of the rectangular component, which is opposite from the two adjacent comers. The latch is configured to cooperate with the pair of spaced support means to support the rectangular component in parallel relation to the wall when the latch is in a first undeformed position, and to allow installation or removal of said rectangular component when said latch is in a second deformed position.

BRIEF DESCRIPTION OF THE DRAWINGS

The invention may be better understood and its objects and advantages will become apparent to those skilled in the art by reference to the accompanying drawings, in which.

BEST MODE FOR CARRYING OUT THE INVENTION AND INDUSTRIAL APPLICABILITY

Figure 1:
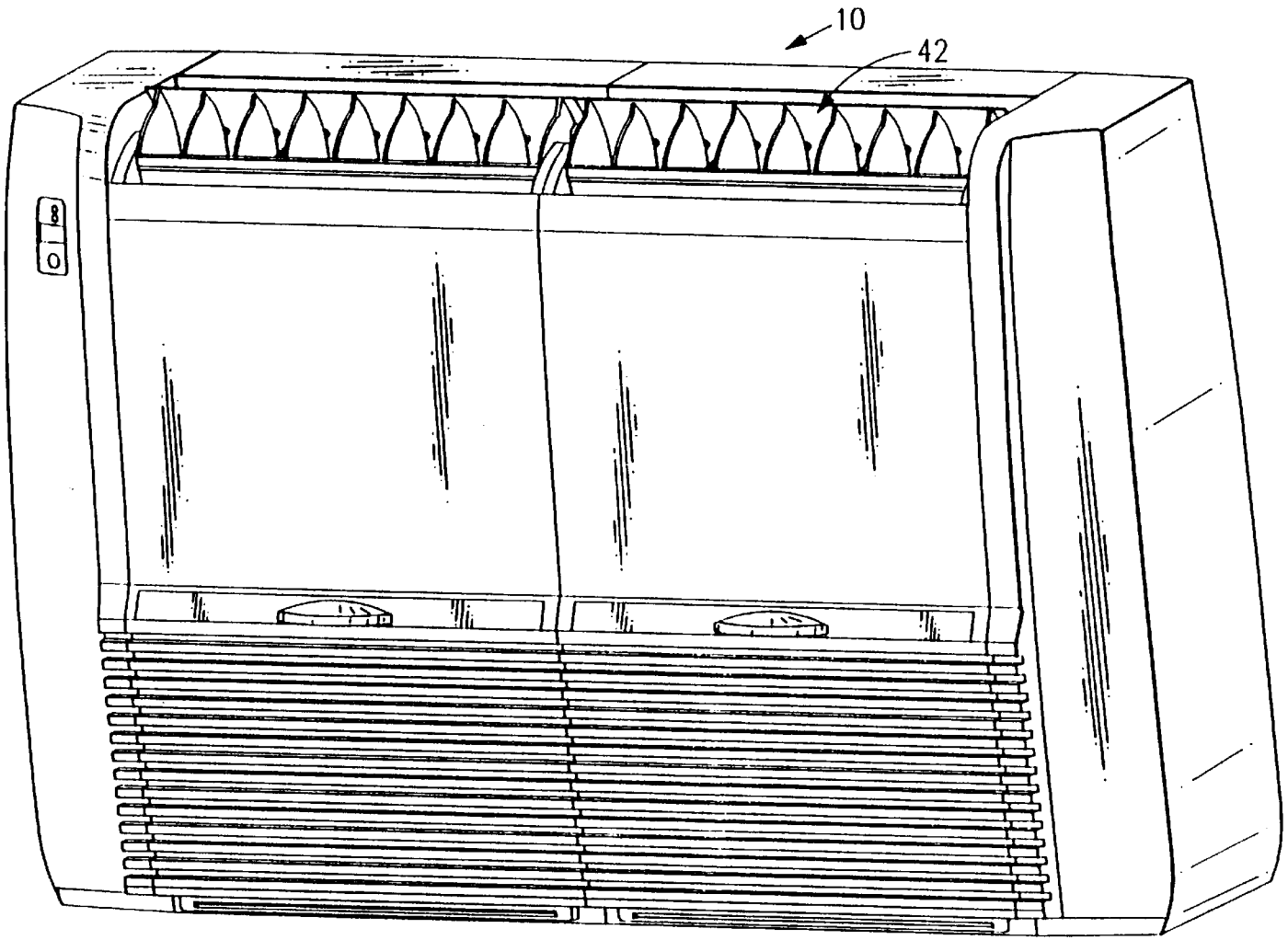
FIG. 1 is a perspective view of the indoor unit of an air conditioner which embodies the features of the present invention.
Figure 5:
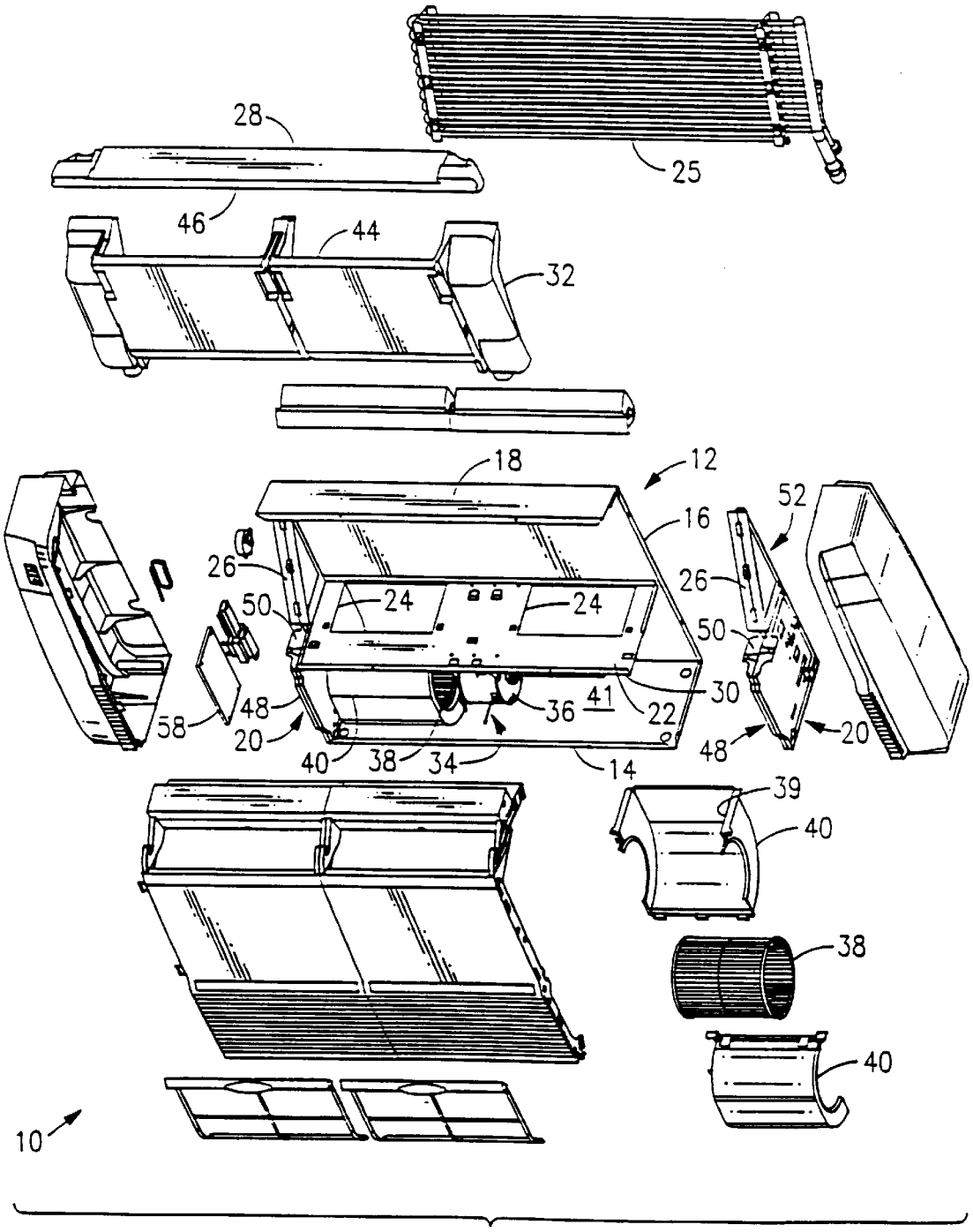
FIG. 5 is an exploded perspective view of the air conditioning unit of FIG. 1.

Looking first at FIGS. 1 and 5, the indoor unit 10 of a split system air conditioning system of the type incorporating the mounting of electronic components according to the present invention is illustrated. Briefly, the unit 10 includes a main structural support frame 12, which includes a bottom panel 14, a back panel 16 and a top section 18. Attached to the sides of the back and top panels are structural internal side covers 20. The side covers 20 and the back panel 16 cooperate to support a horizontally extending fan support panel 22, which includes a pair of rectangular openings formed therein. Mounted above the fan support panel 22 on a pair of inclined surfaces 26, defined by the internal side covers 20 is a heat exchanger coil 25.

Mounted under the top section of the main support frame 12 is an upper condensate collection pan 28. Mounted in the front of the unit, under the bottom of the heat exchanger 25, and supported by the front edge 30 of the fan support panel 22, is a lower condensate collection pan 32. A front section of the lower condensate collection pan extends upwardly and is spaced from the heat exchanger coil 25.

Mounted to the lower surface of the fan support panel 22 is a fan assembly 34, which includes an electric motor 36 adapted to drive a pair of centrifugal fans 38, which are each enclosed in a two-piece scroll housing 40. Each of scroll housings 40 defines a rectangular upper air outlet opening 39, which is in air flow communication with the rectangular openings 24 in the fan support panel 22.

As a result of the above-described arrangement of components, when the fan assembly is energized, air is drawn into the region 41 underlying the fan support panel 22 through the open front and is directed upwardly through the rectangular openings 24, through the heat exchanger coil 25 and is discharged through an opening 42 defined by the upper edge 44 of the lower condensate pan 32 and the front edge 46 of the upper condensate pan 28.

The main structural framework 12 and the fan support panel 22 are preferably fabricated from a structural galvanized sheet material and are assembled as illustrated in FIG. 5 with the fan support panel supported by the back 16 of the frame 12 and by the internal side covers 20 at the left and right-hand sides thereof. The internal side covers 20 are molded from a structural plastic material and include a lower substantially rectangular section 48, which defines a horizontally extending support surface 50 at its upper end thereof, which serves to support the fan panel 22. The upper end of the internal side covers 20 comprise a triangular shaped section 52, which includes the inclined heat exchanger supporting surfaces 26 and have a downwardly spacing surface 52, which cooperates with the surface 50 of the rectangular section to support the fan support panel 22.

Figure 2:
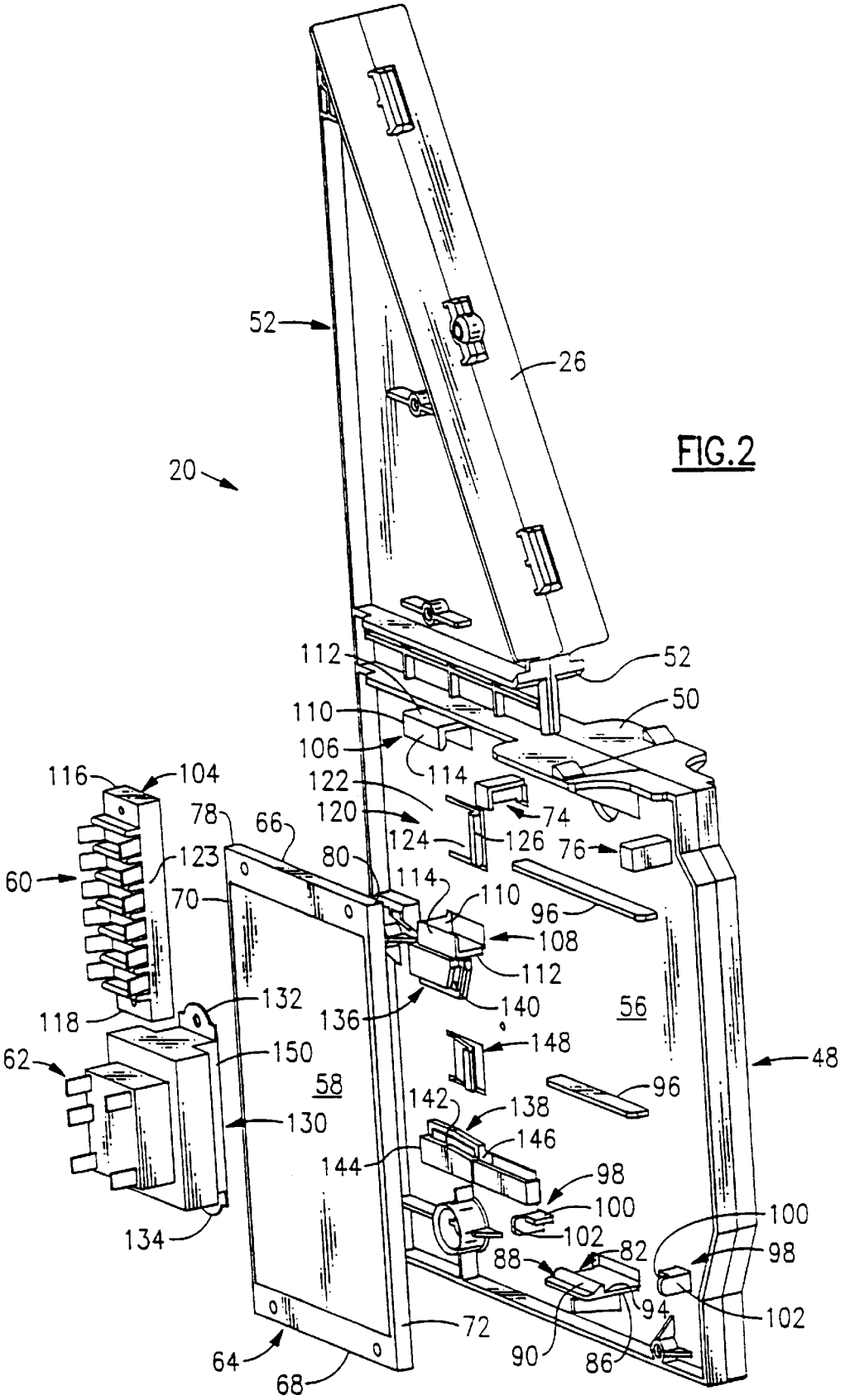
FIG. 2 is an enlarged perspective of the left internal side cover the air conditioning unit of FIG. 1 showing certain electrical/electronic components to be assembled thereto.
Figure 3:
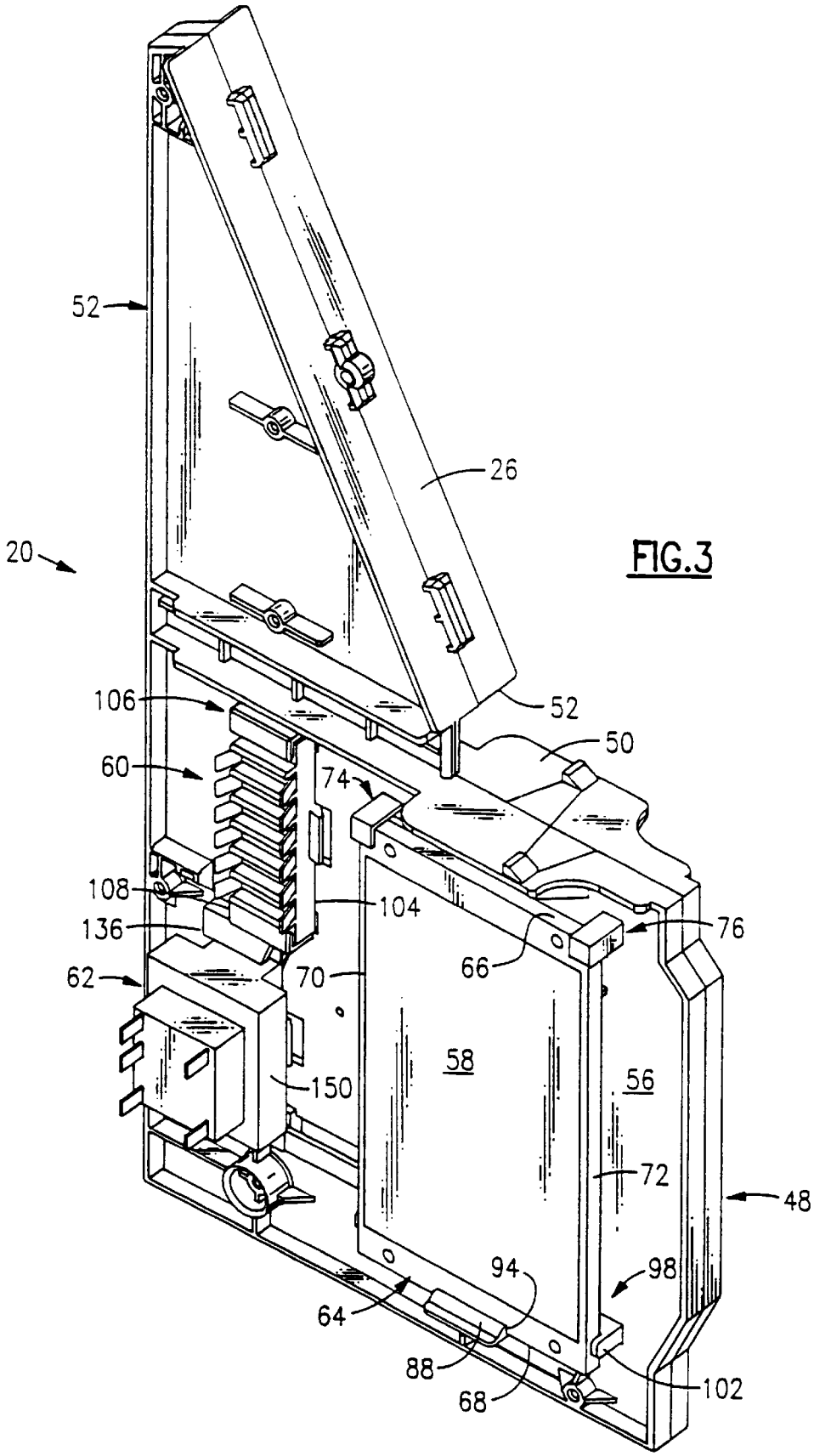
FIG. 3 is a view similar to FIG. 2 illustrating the components assembled to the internal side cover.
Figure 4:
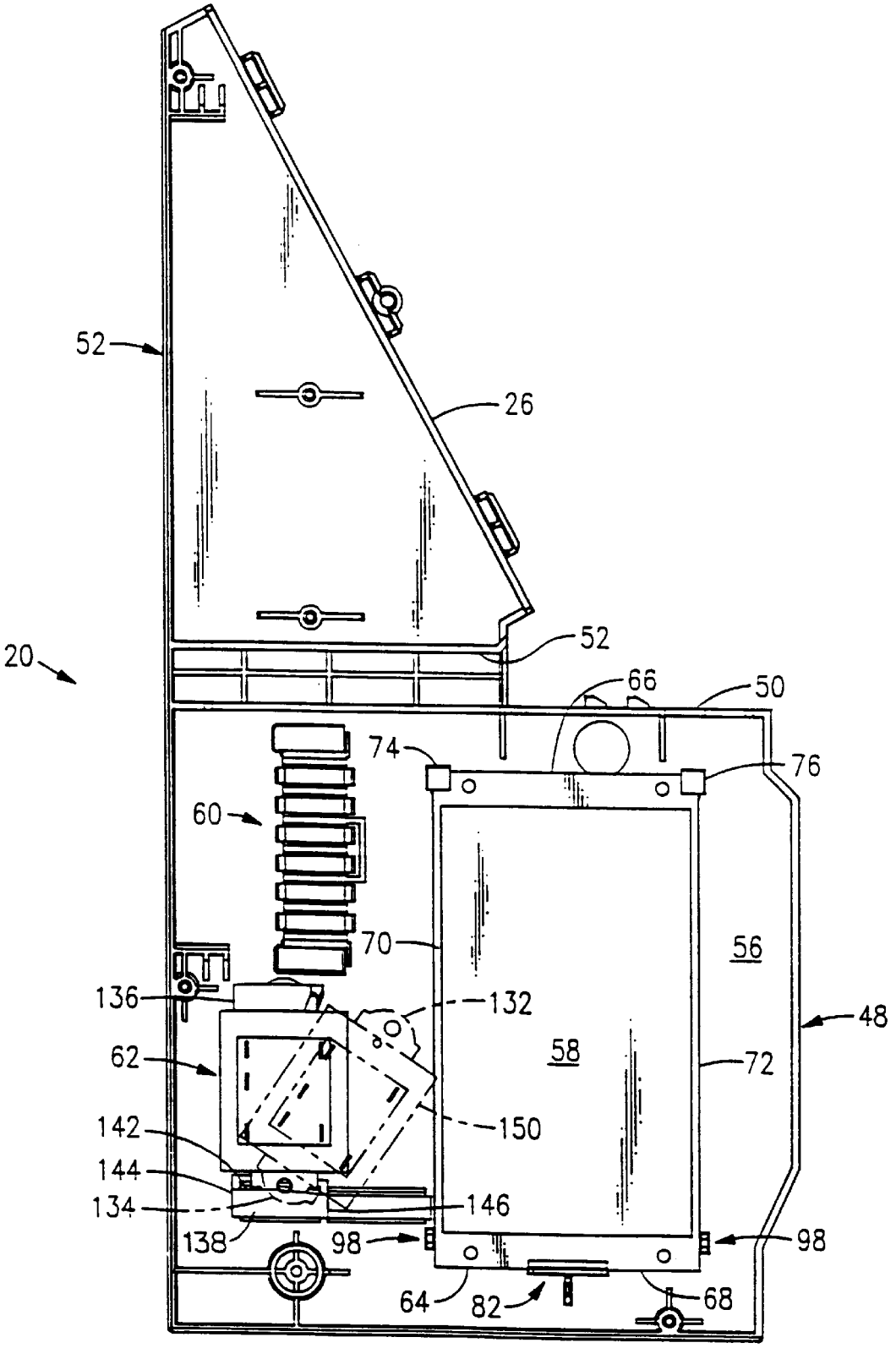
FIG. 4 is a side view of the internal side cover of FIGS. 2 and 3 illustrating the details of the assembly of the transformer thereto.

Looking now at FIGS. 2, 3 and 4 in detail, the left-hand facing surface 56 of the rectangular section 48 of the left internal side cover 20 serves to mount the electronic and electrical control components of the indoor air conditioning unit 10. Specifically, mounted on the surface 56 is an electronic circuit board 58, a terminal strip 60, and a transformer 62. Each of these components includes a substantially rectangular shaped base mounting section and is mounted to the surface 56 by mounting means, which will be described in detail hereinbelow. The mounting means basically serves to support two adjacent corners of a component and engages the side of the rectangular component opposite from the adjacent corners with a deformable latching means.

Looking now at the electronic circuit board 58, the board is shown in a substantially simplified manner not illustrating the resistors, capacitors, integrated circuits, etc., which are mounted thereon. The main support of the board comprises a horizontally extending rectangular base 64, which includes top and bottom edges 66 and 68, respectively, and left and right edges 70 and 72, respectively. Integrally molded at the upper end of the support surface 56 are a pair of left and right-hand corner supports 74 and 76, respectively, which are adapted to engage the left and right upper corners 78 and 80 of the circuit board base 64. The corner supports engage a length of both the top edge 66 and the respective right or left-hand edge 70 or 72. Integrally molded with the support surface 56 at the lower end thereof is a deformable latch 82, which is adapted to engage bottom edge 68 of the base 64 of the circuit board. As is best seen in FIG. 2, the latch 82 has one end thereof integrally molded with the wall 56 and includes a flexible elongated section 86 extending outwardly from the wall and which terminates in a latching head 88 at the outer end thereof.

As is best seen in FIG. 3, the circuit board 58 is installed by first inserting the left and right corners 78 and 80 into the their respective upper supports 74 and 76 and thereafter engaging the bottom edge 68 with an inclined surface 90 of the latch head 88. Such engagement causes the latch head 88 to flex downwardly until the bottom edge 68 moves behind the latch head 88 and is engaged by a vertically extending retaining surface 94 of the latch head 88. As so engaged, the deformable latch 82 cooperates with the upper corner supports 74 and 76 to prevent horizontal and vertical movement of the circuit board 58.

It will be noted from FIG. 2 that the support surface 56 includes a pair of horizontally extending spacer elements 96 extending outwardly from the surface and adapted to engage the back side of the base 64 of the circuit board 58 to thereby cooperate with the deformable latch 82 and the upper right and left corner supports 72 and 74 to support the circuit board in spaced relation from the support surface 56. Further molded into the support 56 are a pair of combination lateral support spacer elements 98 located adjacent the deformable latch 82 and adapted to engage the left and right edges 70 and 72 of the base 64. As best seen in FIGS. 2 and 3, each of these combination elements includes a spacer section 100 extending outwardly from the surface 56 the same height as the spacers 96 and an integrally formed lateral support 102 adapted to engage the sides of the base 64 to further laterally support the circuit board 58.

Looking now at the terminal strip 60, the strip comprises a vertically extending rectangular insulating base 104. Looking at the upper left-hand corner of the support surface 56 of the internal side cover 20, it will be noted that upper and lower terminal strips support elements 106 and 108 integrally molded into the surface 56. As best seen in FIG. 2, each of the upper and lower supports comprises a three sided receptacle having a left-hand side 110, a bottom (or top) 112 and a front 114. The supports are open on the right-hand side and are adapted to receive the full width of the upper and lower ends 116 and 118 of the terminal strip base 104 therein.

As best seen in FIG. 2, a deformable latch 120 is integrally molded into the wall 56 and is adapted to engage the right-hand wall 123 of the base 104 when the top and bottom 116 and 118 of the base are fully inserted into the upper and lower supports 106 and 108. The flexible latch 120 comprises a fixed end 122 forming a part of the surface 56, an elongated horizontally extending flex section 124 which is coincident with the surface 56, and a latch head 126 at the free end of the flex section.

The elongated flex section 124 supports the latch head 126 at a location spaced outwardly from the surface 56 and is caused to be flexed inwardly to a deformed position as the base 104 is being inserted into the upper and lower supports 106 and 108, and returns to its unflexed position with the latch head 126 in engagement with the right-hand edge 128 of the base when fully inserted to thereby positively retain the terminal strip.

Looking now at the transformer 62, the transformer includes a sheet metal mounting plate 130 attached to the back side thereof, which includes upper and lower vertically extending mounting tabs 132 and 134, respectively. Molded into the support surface 56 are upper and lower tab receiving supports 136 and 138, respectively. The upper tab support 136 is similar in structure to the upper support 106, described above in connection with the mounting of the terminal strip 60 and basically defines a tab receiving slot closed at the top, left side and front and open ended at the right hand side 140 to receive the tab 132 therein. The lower tab support 138 defines a slot 142 closed at both the left and right-hand ends 144 and 146.

The transformer 62 is assembled to the supports as illustrated in FIG. 4 with the transformer 62 oriented at an approximately forty-five degree angle and the lower tab 134 inserted into the slot 142. Following this, the upper end of the transformer is rotated to the left so that the upper tab 132 moves from right to left into the open end 140 of the upper support 136 with the transformer oriented vertically, as illustrated in FIG. 3. A flexible latch 148 underlies the transformer mounting plate 130 and is adapted to engage the right-hand side 150 thereof when the transformer is in the installed positioned. The flexible latch is substantially identical to the latch 120 described above in connection with the mounting of the terminal strip 60.

What is claimed is:

1. An air conditioning unit comprising:

a vertically extending structural wall forming an internal side of said unit, said wall being molded from a structural plastic material;

said wall having a pair of spaced support means molded integrally therewith, said spaced support means being configured to supportingly engage two adjacent comers of a substantially rectangular electrical component; and said wall further having a deformable latch formed integrally therewith at a location to engage the side of said rectangular component which is opposite from said two adjacent corners, said latch being configured to cooperate with said pair of spaced support means to support said rectangular component in parallel relation to said wall when said latch is in a first undeformed position and to allow installation or removal of said rectangular component when said latch is in a second deformed position.

2. The apparatus of claim 1 wherein said deformable latch comprises:

one end thereof integrally, fixedly formed with said wall;

a flexible elongated section extending from said one end thereof in a direction substantially perpendicular to and away from said wall; and a latching head formed at the other end thereof.

3. The apparatus of claim 1 wherein said wall further includes a spacer, integrally molded therein, said spacer being configured to underlie and engage said rectangular component to cause said component to be supported in spaced relation to said wall.

4. The apparatus of claim 3 wherein said wall further includes lateral positioning means integrally formed therewith configured to engage respectively opposite lateral sides of said rectangular component, proximate the two adjacent corners opposite from said two adjacent corners engaged by said spaced support means.

5. The apparatus of claim 4 wherein each of said lateral support means further comprises a spacer.

6. The apparatus of claim 1 wherein said deformable latch comprises a fixed end formed integrally with said wall and an elongated flexible section extending substantially parallel to said wall;

said flexible section having a latching head formed at the other end thereof.

* * * * *